US005454769A

United States Patent [19]

Chen

[11] Patent Number: 5,454,769

[45] Date of Patent: Oct. 3, 1995

[54] WRIST AND FOREARM EXERCISE APPARATUS WITH IMPROVED RESISTANCE ADJUSTMENT DEVICE

[76] Inventor: Ping Chen, No. 20, Nan-Mei St., Taichung City, Taiwan

[21] Appl. No.: 401,628

[22] Filed: Mar. 9, 1995

[51] Int. Cl.[6] ..... A63B 5/00

[52] U.S. Cl. ..... 482/46; 482/124; 482/128; 482/908

[58] Field of Search ..... 482/44, 46, 49, 482/45, 124, 128, 908, 121, 122, 131, 133, 134

[56] References Cited

U.S. PATENT DOCUMENTS

| | | | |
|---|---|---|---|
| 4,513,962 | 4/1985 | Robson et al. | 482/49 |
| 4,589,655 | 5/1986 | Amnon | 482/46 |
| 4,726,580 | 2/1988 | Batiste et al. | 482/128 |
| 5,100,126 | 3/1992 | Liou | 482/46 |
| 5,407,407 | 4/1985 | Lin | 482/908 |

*Primary Examiner*—Stephen R. Crow
*Attorney, Agent, or Firm*—Ladas & Parry

[57] ABSTRACT

A wrist and forearm exercise apparatus includes a forearm support unit for extension of a forearm of a user therethrough, a grip assembly mounted swingably on the forearm support unit for gripping by a hand of the user, and a resistance adjustment device. The forearm support unit includes a tubular body having a peripheral wall with an intermediate portion formed with a stepped groove. The stepped groove includes several L-shaped sections, each of which has an axial portion and a radial portion. A coiled compression spring is accommodated within an adjustment tube which has a front end portion mounted slidably within the tubular body. A radial pin is fixed on the adjustment tube and engages the stepped groove. Movement and rotation of the adjustment tube relative to the tubular body moves the pin in the stepped groove so as to change the compressed extent of the spring, thereby adjusting the resistance to the swinging movement of the grip assembly on the forearm support unit.

3 Claims, 6 Drawing Sheets

WRIST AND FOREARM EXERCISE APPARATUS WITH IMPROVED RESISTANCE ADJUSTMENT DEVICE

BACKGROUND OF THE INVENTION

1. Field of the Invention

This invention relates to a wrist and forearm exercise apparatus more particularly to a wrist and forearm exercise apparatus with a resistance adjustment device.

2. Description of the Related Art

The improvement of this invention is directed to the conventional wrist and forearm exercise apparatus shown in FIG. 1. As illustrated, the conventional exercise apparatus includes an annular forearm support unit 1, a grip assembly 2 and a resistance adjustment device 3. The forearm support unit 1 includes a curved upper plate 1*a*, a curved lower plate 1*b* integrally formed with the upper plate 1*a*, a tubular body 1*c* secured to the upper plate 1*a* and which has a central bore 1*d*, an opening 1*e* formed through the front end wall of the tubular body 1*c*, and an externally threaded rear end portion 1*f*. The grip assembly 2 includes a pivot portion 2*a* mounted pivotally on the forearm support unit 2*b*, a grip portion 2*b* located at the front end portion of the grip assembly 2, and a pull portion 2*c* located at the rear end portion of the grip assembly 2. The resistance adjustment device 3 includes a spring accommodating tube 3*a* with a slide slot 3*a* formed at the front end portion thereof, a sliding piece 3*b* disposed slidably in the spring accommodating tube 3, an externally threaded movable inner tube 3*c* disposed within the spring accommodating tube 3*a* and provided with a radial guide pin 3*c*' slidable in the slide slot 3*a*' so as to prevent rotation of the inner tube 3*c* relative to the spring accommodating tube 3*a*, a cord 3*d* with a rear end fastened to the sliding piece 3*b*, and a front end coupled with the grip assembly 2, a coiled compression spring 3*e* disposed within the spring accommodating tube 3*a* and sleeved on the cord 3*e* between the sliding. piece 3*b* and the inner tube 3*c*, and an adjustment ring 3*f*.

As shown in FIG. 1A, the adjustment ring 3*f* has a small-diameter threaded hole 31*f* engaging threadably the inner tube 3*c*, and a large-diameter threaded hole 32*f* engaging threadably the threaded rear end portion if of the tubular body 1*c*. When it is desired to adjust the resistance to the swinging movement of the grip assembly 2 on the forearm support unit 1, the adjustment ring 3*f* is rotated on the tubular body 1*c* so as to move the inner tube 3*c* within the spring accommodating tube 3*c*, thus compressing the spring 3*e* to a selected extent. However, it is difficult to control the adjusted amount of the compression of the spring 3*e* due to the stepless adjustment of the ring 3*f*.

SUMMARY OF THE INVENTION

The object of this invention is to provide a wrist and forearm exercise with an improved resistance adjustment device whereby the resistance to operation of the apparatus can be easily adjusted in a stepwise manner.

According to this invention, a wrist and forearm exercise apparatus includes a forearm support unit for extension of a user's forearm therethrough, a grip assembly mounted swingably on the forearm support unit for gripping by a hand of the user thereon, and a resistance adjustment device. The forearm support unit includes a tubular body having a peripheral wall with an intermediate portion formed with a stepped groove. The stepped groove includes several L-shaped sections, each of which has an axial portion and a radial portion. A coiled compression spring is accommodated within an adjustment tube which has a front end portion mounted slidably within the tubular body. A radial pin is fixed on the adjustment tube and engages the stepped groove of the tubular body. Movement and rotation of the adjustment tube relative to the tubular body moves the pin in the stepped groove so as to change the compressed extent of the spring, thereby adjusting the resistance to the swinging movement of the grip assembly on the forearm support unit.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1A:
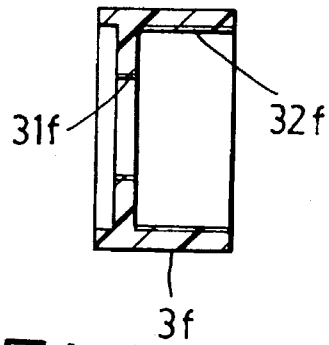
FIG.1A PRIOR ART
FIG. 1A is a sectional view showing the adjustment ring of the conventional wrist and forearm exercise apparatus.
Figure 1:
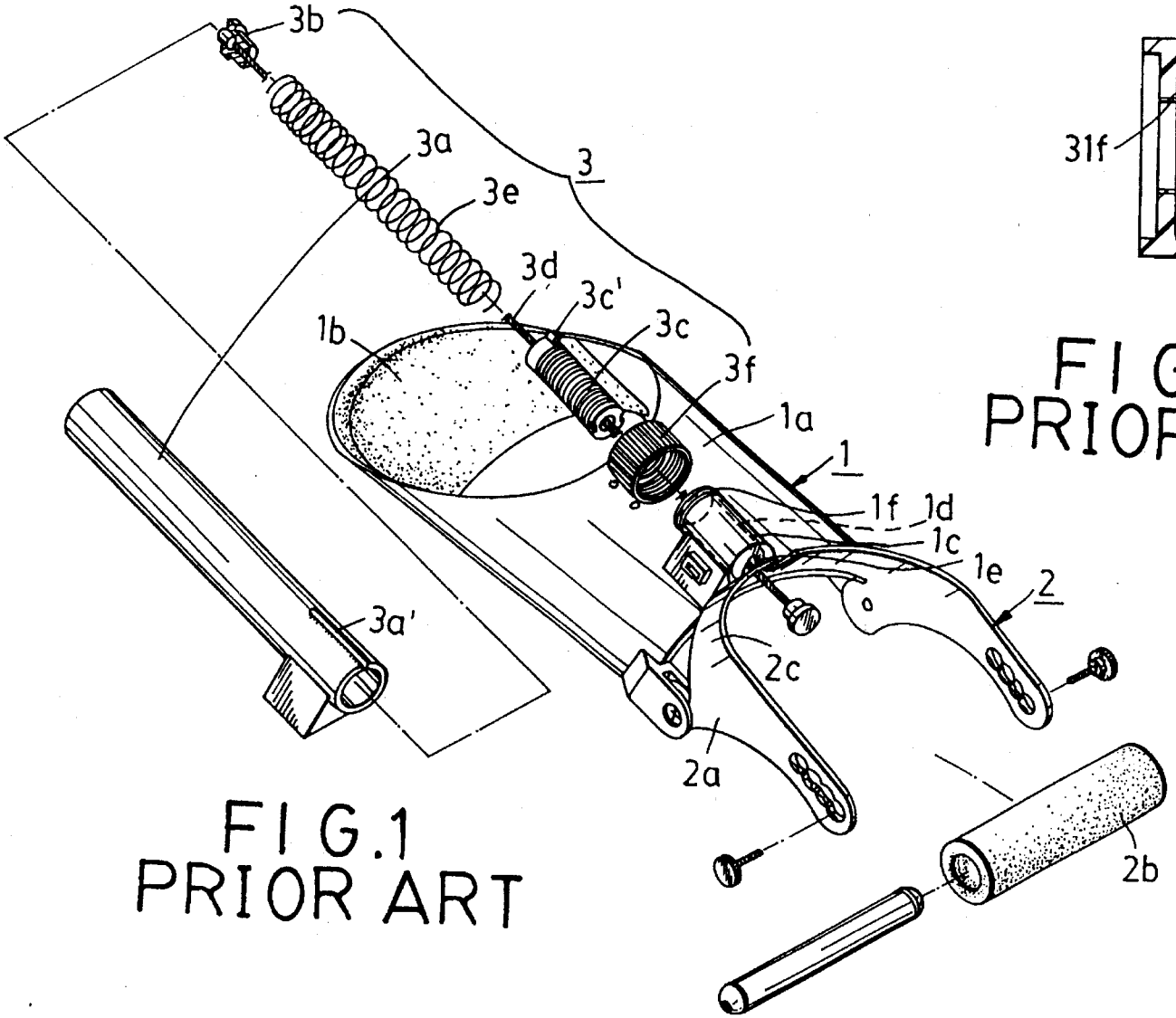
FIG.1 PRIOR ART
FIG. 1 is an exploded view of a conventional wrist and forearm exercise apparatus.
Figures 2, 2A:
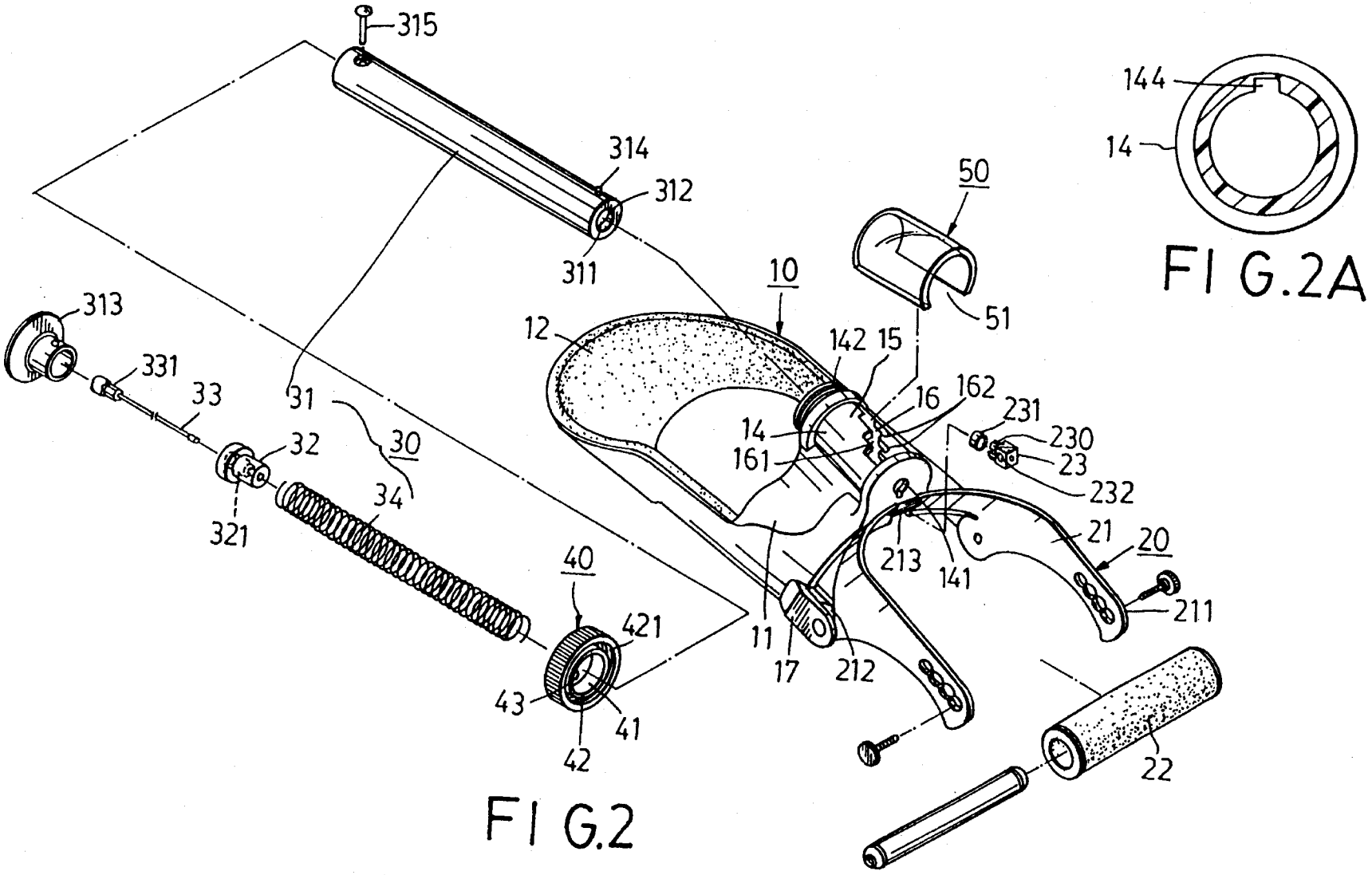
FIG. 2 is an exploded view of a wrist and forearm exercise apparatus according to this invention.
FIG. 2A is a sectional view showing the rear end portion of the tubular body of the forearm support unit of the wrist and forearm exercise apparatus according to this invention.
Figure 3:
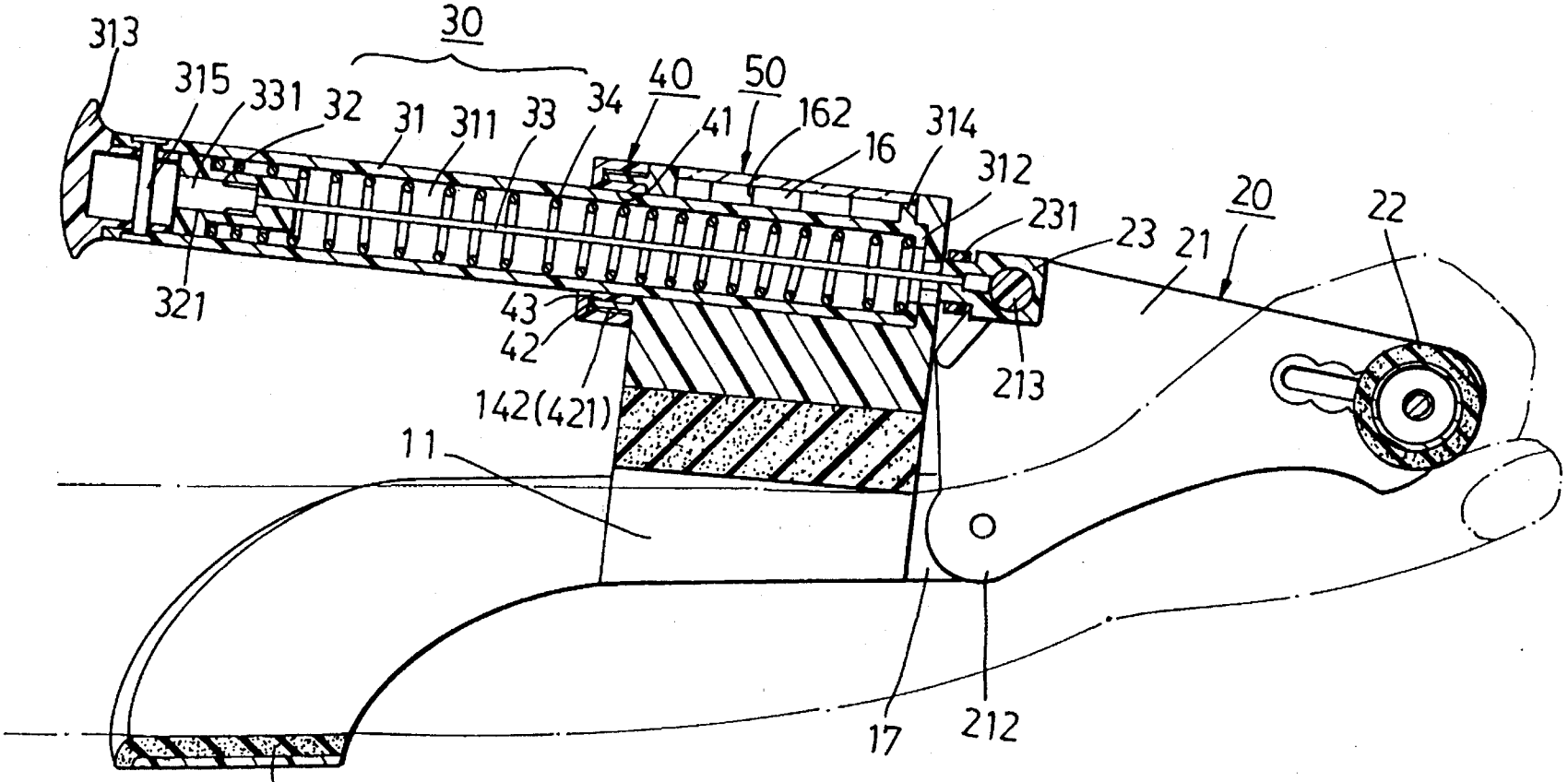
FIGS. 3 and 4 are sectional views illustrating the use of the wrist and forearm exercise apparatus according to this invention.

Referring to FIGS. 2 and 3, a wrist and forearm exercise apparatus of this invention includes an annular forearm support unit 10, a grip assembly 20, a resistance adjustment device 30, a nut member 40 and a C-shaped transparent cover 50.

The forearm support unit 10 includes a curved upper plate 11, a curved lower plate 12 integrally formed with the upper plate 11, a tubular body 14 secured on the upper plate 11, and two U-shaped brackets 17 on which the grip assembly 20 is mounted pivotally. The tubular body 14 has a central hole 141 formed through the front end wall thereof, and an externally threaded rear end portion 142. A recess 15 has a C-shaped cross-section and is formed in the upper portion of the peripheral wall of the tubular body 14. The cover 50 engages fittingly the recess 15. A stepped groove 16 is formed through the intermediate portion of the peripheral wall of the tubular body 14 and consists of several L-shaped sections 161, each of which has an axial portion and a radial portion with an end connected communicatively with an end of the axial portion.

Figure 5:
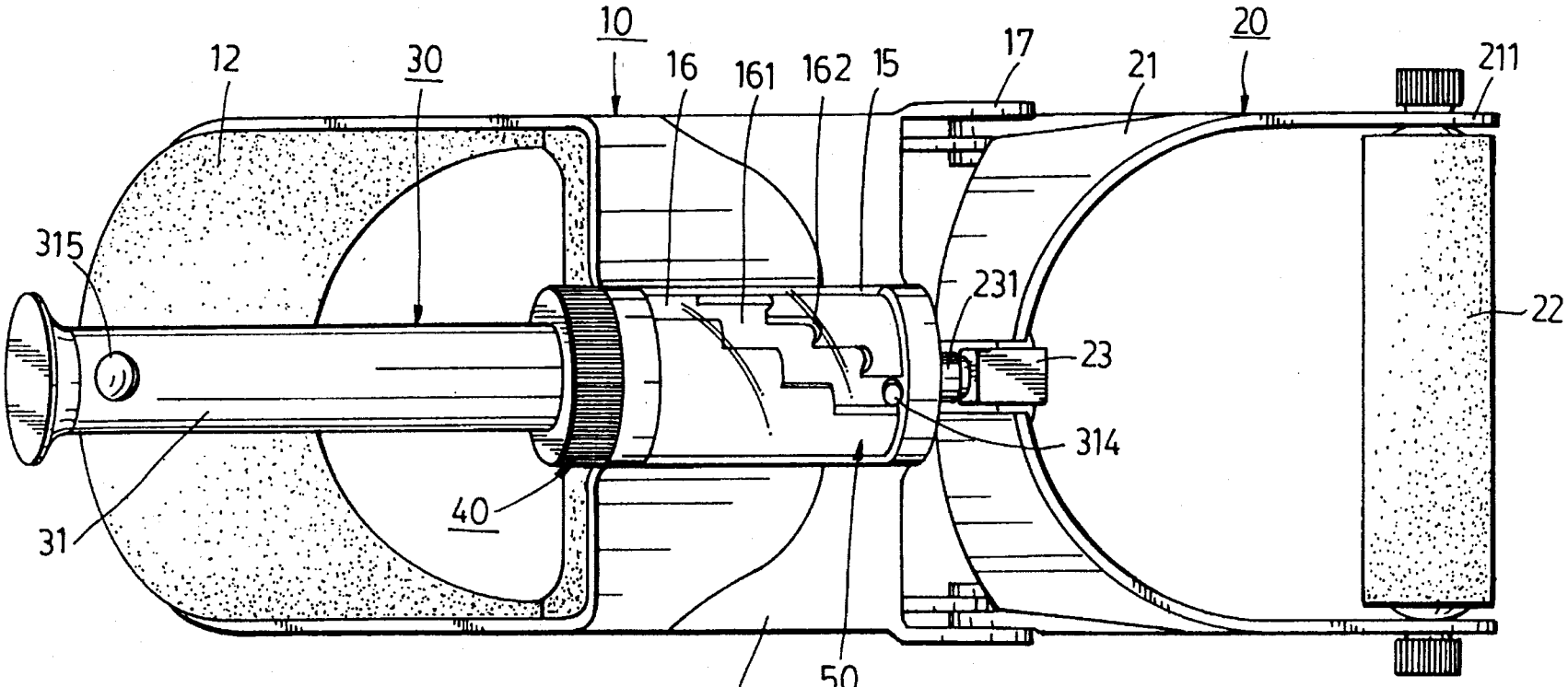
FIG. 5 is an elevational top view showing the wrist and forearm exercise apparatus of this invention.

As shown in FIGS. 2 and 5, each of the rearward walls which defines the radial portions of the L-shaped sections 161 of the stepped groove 16 has a concave positioning notch 162.

The grip assembly 20 includes a U-shaped swing plate 21, a grip portion 22 coupled with two arms of the swing plate 21 at two ends thereof in a known manner, and a coupler 23. The U-shaped swing plate 21 has a pivot portion consisting of two ears 212 which are respectively and rotatably connected to the brackets 17 of the forearm support unit 10. The rear portion of the coupler 23 has a slitted tongue unit 230 which has a retaining ring 231 sleeved thereon and which is divided into two halves by a slit that is communicated with a transverse pivot hole 232 formed through the front portion of the coupler 23. A pivot pin or pull portion 213 is secured to the rear end portion of the grip assembly 20 and extends through the pivot hole 232 of the coupler 23.

The resistance adjustment device 30 includes an adjustment tube 31 which has a front portion mounted slidably within the tubular body 14, a sliding piece 32 disposed slidably within the rear portion of the adjustment tube 31, a cord 33 that extends through the front portion of the central bore 311 of the adjustment tube 31 and that has a front end retained on the coupler 23 and a rear end fastened to a stopper 331 plugged into a stepped hole 321 of the sliding piece 32, and a coiled compression spring 34 which is sleeved on the cord 33 and which is received in the adjustment tube 31 between the sliding piece 32 and a radially and inwardly extending flange 312 at the front end of the adjustment tube 31 so as to bias the grip assembly 20 to rotate counterclockwise. A cap 313 is plugged into the open rear end of the adjustment tube 31. A radial pin 314 is fixed on the peripheral outer surface of the front end portion of the adjustment tube 31 and engages the stepped groove 16 of the tubular body 14. In assembly, the radial pin 314 is moved into the stepped groove 16 through an open-ended slot 144 (see FIG. 2A) formed in the rear end portion of the tubular body 14. The cap 313 is locked on the adjustment tube 31 by means of a positioning pin 315.

The nut member 40 has a central hole 41 for extension of the adjustment tube 31, the cord 33 and the spring 34 therethrough, and an annular groove 42 which defines an inner ring 43. The externally threaded rear end portion 142 of the tubular body 14 engages within the annular groove 42 of the nut member 40 and further engages threadably the internally threaded portion 421 of the nut member 40. The cover 50 is made of a resilient material and has a C-shaped cross-section. The cover 50 has two aligned bottom sides that are spaced apart at a distance smaller than that of the recess 15 of tubular body 14 when the cover 50 is removed from the tubular body 14.

Figure 4:
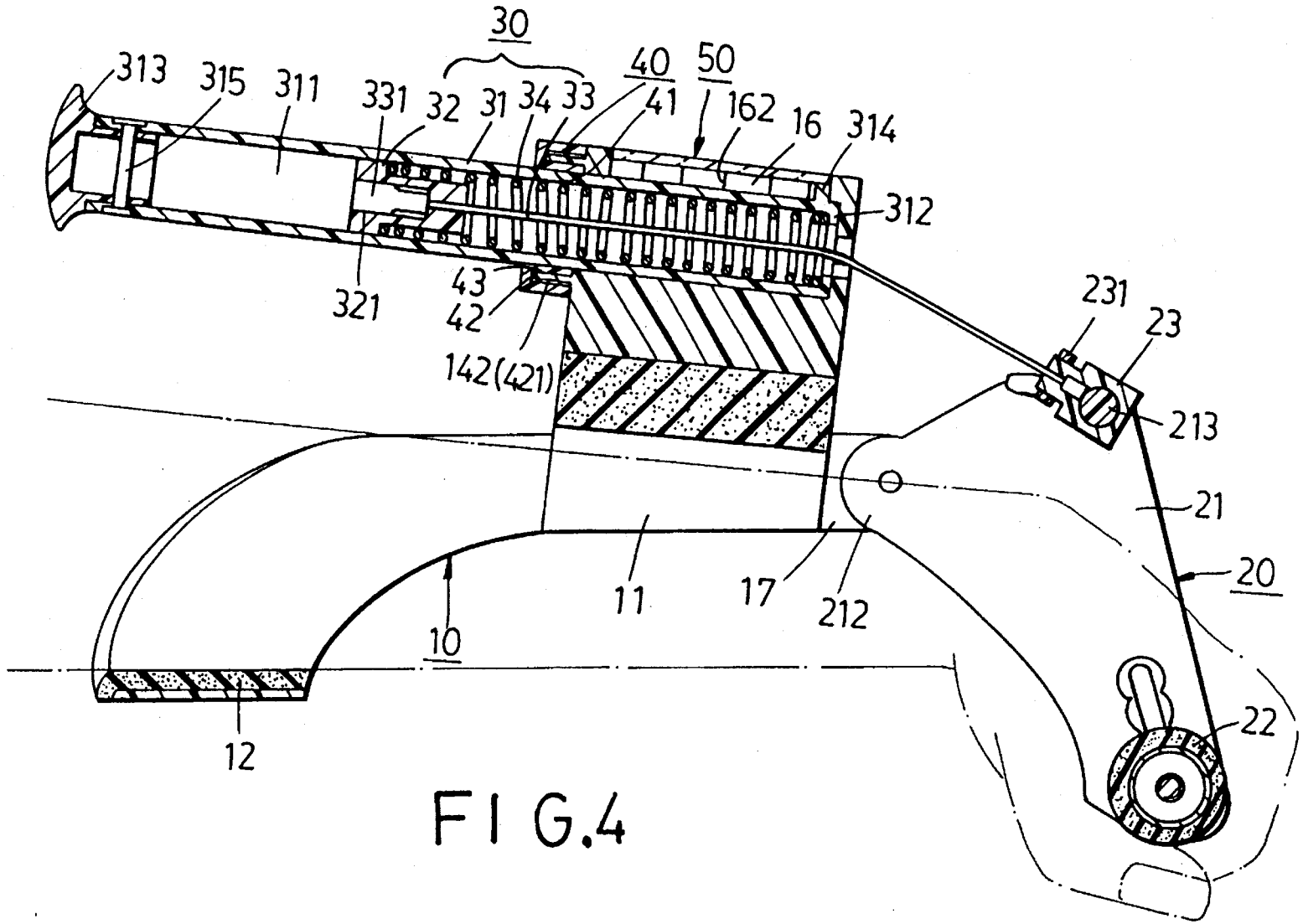

Referring to FIGS. 3 and 4, in use, a forearm of the user is passed through the annular forearm support unit 10. Then, the hand of the user grips the grip portion 22 of the grip assembly 20. When the hand is turned downward, the cord 33 is pulled forward in the adjustment tube 31 so as to further compress the spring 34.

Figure 6:
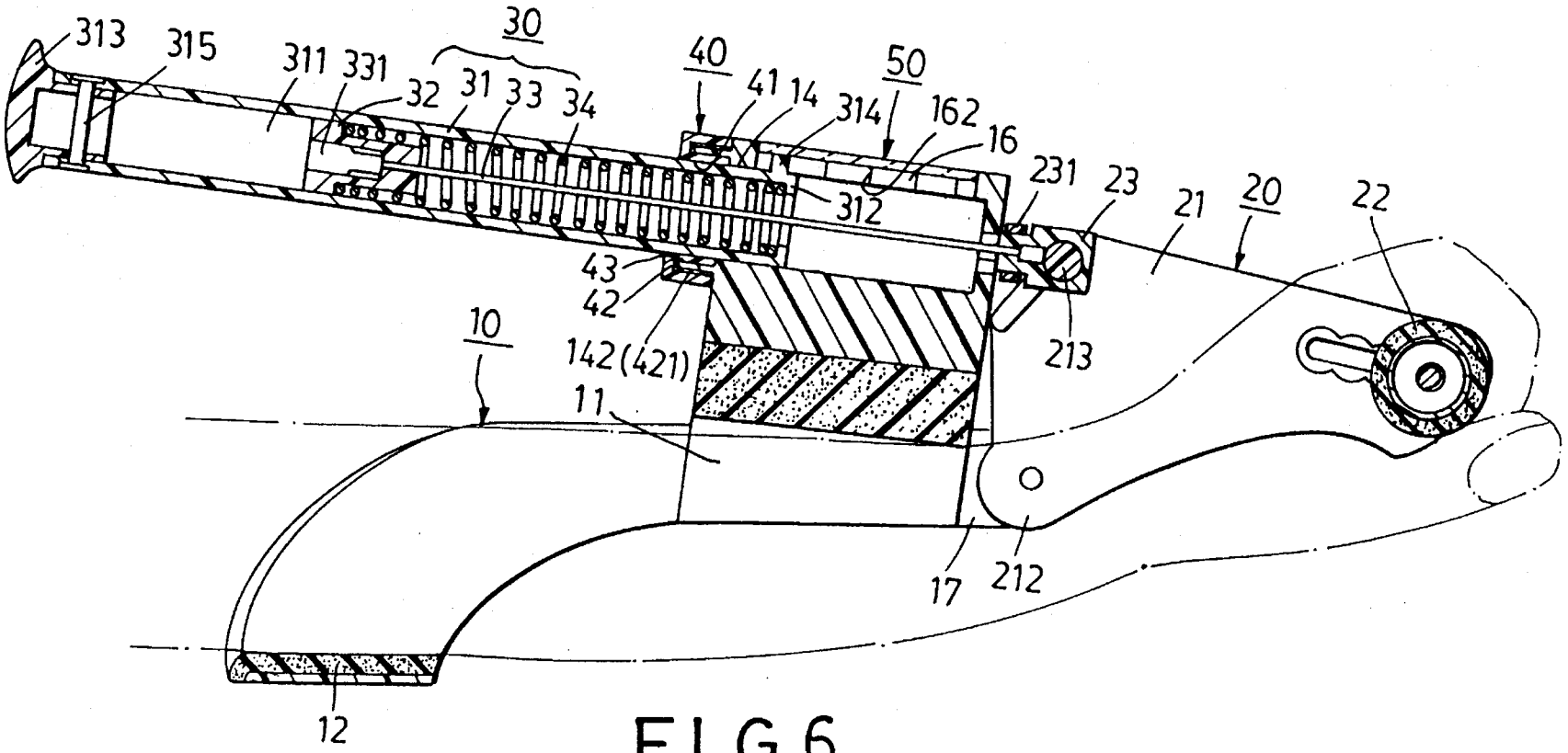
FIG. 6 is a sectional view illustrating the adjustment of the wrist and forearm exercise apparatus according to this invention.

When it is desired to adjust the resistance to the swinging movement of the grip assembly 20 on the forearm support unit 10, the adjustment tube 31 is moved and rotated relative to the tubular body 14 so as to move the pin 314 along the stepped groove 16, thereby changing the compressed extent of the spring 34 and thus the pull force of the cord 33 toward the pivot pin 213 of the grip assembly 20. For example, the adjustment tube 31 can be moved rearward in the tubular body 14 from the position of FIG. 3 to the position of FIG. 6, so as to further compress the spring 34, thus increasing the resistance to operation of the apparatus. When the pin 314 is moved to a selected position in the stepped groove 16, the spring 34 biases the pin 314 to engage one of the positioning notches 162 so as to position the pin 314 in the stepped groove 16. Accordingly, the adjustment of the resistance can be effected easily in a stepwise manner.

With this invention thus explained, it is apparent that numerous modifications and variations can be made without departing from the scope and spirit of this invention. It is therefore intended that this invention be limited only as indicated in the appended claims.

I claim:

1. A wrist and forearm exercise apparatus including an annular forearm support unit adapted to permit a forearm of a user to extend therethrough, a grip assembly mounted swingably on said forearm support unit and adapted to permit a hand of the user to grip said grip assembly in order to swing said grip assembly on said forearm support unit, and a resistance adjustment device which includes a cord having a front end and a rear end and interconnecting said grip assembly and said forearm support unit, and a coiled compression spring sleeved on said cord and compressed to a selected extent so as to bias said grip assembly to rotate in a direction, thereby creating a resistance to swinging movement of said grip assembly on said forearm support unit, said grip assembly having a pivot portion mounted pivotally on said forearm support unit, a pull portion fastened to the front end of said cord so that said cord pulls said pull portion of said grip assembly toward said forearm support unit with assistance of said spring, and a grip portion for the hand of the user to grip on, wherein the improvement comprises:

said forearm support unit including a tubular body having a front end wall with a cord hole formed therethrough, and a peripheral wall with a stepped groove formed through an intermediate portion thereof, said stepped groove having several L-shaped sections each of which has an axial portion and a radial portion having an end connected communicatively with an end of said axial portion;

said resistance adjustment device including an adjustment tube which is disposed movably within said tubular body of said forearm support unit and which accommodates said spring therein, said adjustment tube being movable axially within said tubular body so as to adjust compressed extent of said spring, thereby changing the resistance to swinging movement of said grip assembly on said forearm support unit, said resistance adjustment device further including a sliding piece disposed slidably on said adjustment tube, said cord extending through said cord hole of said front end wall of said tubular body and having a front end fastened to said pull portion of said grip assembly, and a rear end fastened to said sliding piece, said spring having a front end positioned in a front end portion of said adjustment tube, and a rear end abutting on said sliding piece so as to bias said adjustment tube forward within said tubular body, and so as to bias said sliding piece to move rearward in said adjustment tube, thereby pulling said pull portion of said grip assembly rearward toward said tubular body, said adjustment tube being provided with a radial pin which is fixed on a peripheral outer surface thereof and which engages slidably said stepped groove of said tubular body of said forearm support unit, engagement of said pin in said stepped groove preventing removal of said adjustment tube from said tubular body of said forearm support unit, movement and rotation of said adjustment tube relative to said tubular body of said forearm support unit moving said pin from an end of said stepped groove to the other end of said stepped groove, thereby adjusting pull force of said cord to said pull portion of said grip assembly.

2. A wrist and forearm exercise apparatus as claimed in claim 1, wherein said peripheral outer surface of said tubular body of said forearm support unit has a recess formed therein, said forearm support unit further including a transparent cover of a generally C-shaped cross-section and made of a resilient material, said cover being engaged fittingly within said recess of said tubular body so as to cover said stepped groove such that said cover nips a portion of said tubular body, in which said recess is formed, whereby, said cover can be removed from said tubular body.

3. A wrist and forearm exercise apparatus as claimed in claim 1, wherein said tubular body has several rearward walls defining said radial portions of said L-shaped sections of said stepped groove, each of said rearward walls having a concave position notch so that said radial pin is pushed to engage a selected one of said positioning notches with the assistance of said spring so as to prevent untimely movement of said radial pin in said stepped groove.

* * * * *